United States Patent [19]

Cappiello

[11] Patent Number: 4,543,804

[45] Date of Patent: Oct. 1, 1985

[54] PIERCED EARRING LOCKING AND HOLDING SYSTEM

[76] Inventor: Frank J. Cappiello, Richter Dr., Danbury, Conn. 06810

[21] Appl. No.: 136,361

[22] Filed: Apr. 1, 1980

Related U.S. Application Data

[63] Continuation of Ser. No. 926,946, Jul. 20, 1978.

[51] Int. Cl.[4] ..... A44C 7/00

[52] U.S. Cl. ..... 63/12; 24/97; 24/99; 24/102 PL

[58] Field of Search ..... 63/12, 13; 24/102 R, 24/102 PL, 102 SL, 102 FC, 97, 98, 99

[56] References Cited

U.S. PATENT DOCUMENTS

| | | | |
|---|---|---|---|
| 155,682 | 10/1874 | Steinheuer | 63/12 |
| 227,922 | 5/1880 | Purdy | 63/12 |
| 332,276 | 12/1885 | Morse | 24/99 |
| 1,428,101 | 9/1922 | Kahn | 24/101 W |
| 1,953,919 | 4/1934 | Bisaillon | 24/97 |
| 2,638,649 | 5/1953 | Meeker | 24/97 |
| 2,645,833 | 7/1953 | Wistedt | 24/97 X |

FOREIGN PATENT DOCUMENTS

| | | | |
|---|---|---|---|
| 212118 | 1/1958 | Australia | 24/97 |
| 31030 | 5/1885 | Fed. Rep. of Germany | 63/12 |
| 230012 | 1/1911 | Fed. Rep. of Germany | 24/99 |
| 175 | 3/1880 | Italy | 24/97 |
| 1440 | of 1884 | United Kingdom | 63/12 |

*Primary Examiner*—F. Barry Shay

*Attorney, Agent, or Firm*—Mattern, Ware, Stoltz & Fressola

[57] ABSTRACT

By providing a slender, elongated shaft having the terminating end portion of the shaft pivotally engaged with the main shaft, a unique, one-piece, pierced earring holding system is achieved. The pierced earring holding system of this invention is usable with any desired pierced earring design, and assures secure and easy attachment to the pierced ears of the user, while also completely eliminating potential loss of the earring.

7 Claims, 16 Drawing Figures

FIG. 9
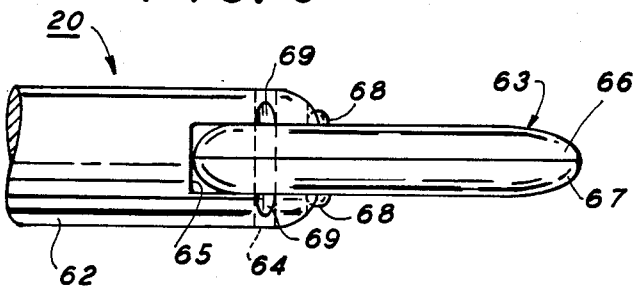
FIG. 10
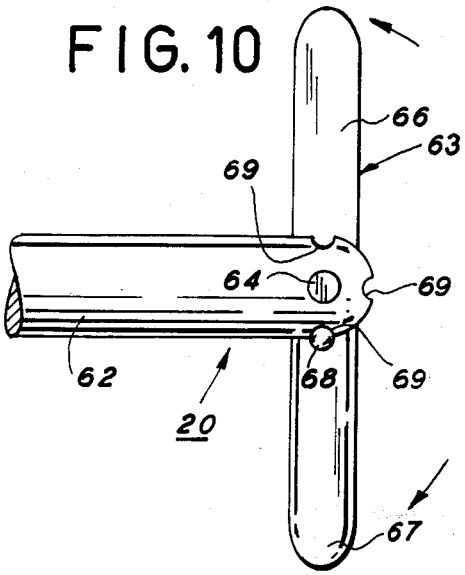
FIG. 11
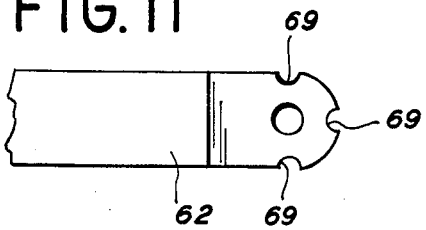
FIG. 13
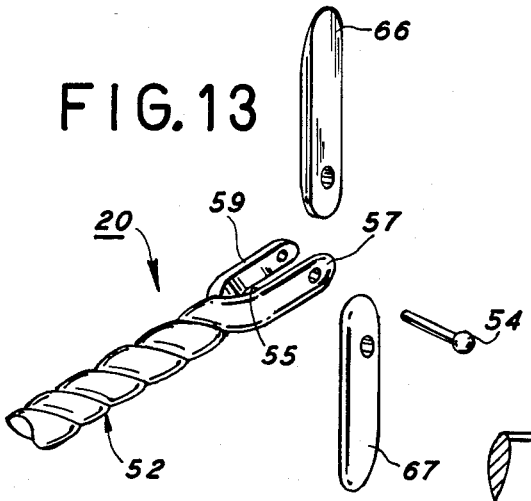
FIG. 12
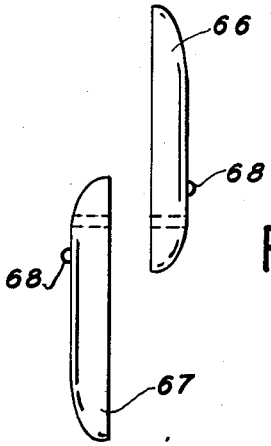
FIG. 14
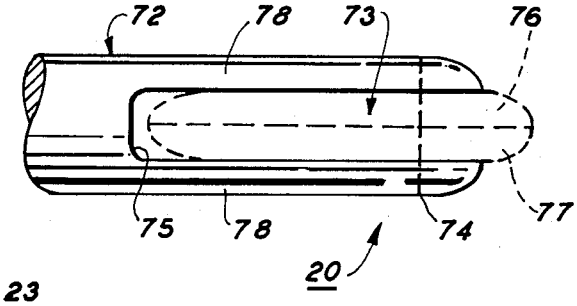
FIG. 15
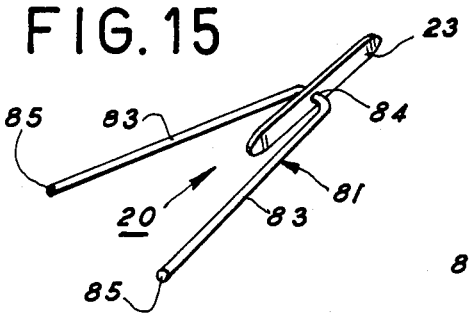
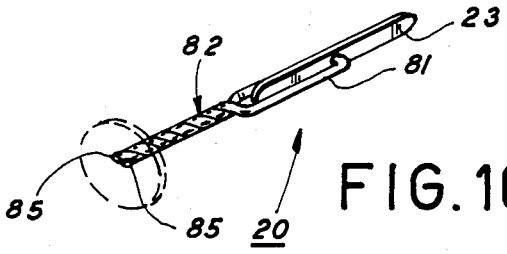
FIG. 16

PIERCED EARRING LOCKING AND HOLDING SYSTEM

This is a continuation of application Ser. No. 926,946 filed July 20, 1978.

BACKGROUND OF THE INVENTION

This invention relates to various constructions for pierced earrings and more particularly to a one-piece pierced earring construction which is quickly, securely and easily locked in position.

For over one hundred years, women have adorned themselves with various ornaments and gems, with their ears being a principal site for such jewelry. Through the many years in which earrings have been used and have been fashioned in various configurations, depending upon the particular style and taste of the period, there have only been two basic earring configurations developed.

One configuration, with which this application is not concerned, is the clip-on type earring. The second category of earrings is the pierced ear type, and represents earring type to which this application is directed.

Although pierced earrings have been used at least since the turn of the century, little change or innovative variations has been realized in the systems used to securely mount the earring in the pierced ear of the user. The typical configuration found in pierced earrings for the last hundred years is a solid, elongated shaft or stem, to which the particular decorative portion of the earring is secured, with a locking mount or a holding nut slidably engagable along the elongated shaft for attachment thereto. Although various alternative constructions for the holding nut of this common type of pierced earring has been developed through the years, all of these holding nuts suffer from common deficiencies.

Initially, these prior art holding nuts were threadedly engaged with the shaft, thereby requiring mating threads in the holding nut and along the shaft of the pierced earring. Such a system is typified by Huber, U.S. Pat. No. 799,056.

It is clearly obvious that this construction suffered from many drawbacks, principally fabrication difficulties and expense to achieve the threaded construction, as well as difficulty of quick and convenient assembly by the user. Since secure engagement of the earring could only be obtained by threadily engaging the locking nut with the threaded shaft of the pierced earring, some expert degree of manipulation and handling was required in order to achieve the threaded engagement of the locking nut on the shaft.

In order to eliminte the necessity of threaded shafts and threaded lock nuts, a straight elongated shaft and slidable lock nut, common in today's market, was developed. In this construction, the lock nut slidably engages the elongated shaft and is advanced along the shaft until securely engaging the shaft near the rear of the user's earlobe, maintaining the earring in its locked position.

Initially, these slidable lock nuts are effective but, after continuous use, the shaft engaging and holding portion formed in the lock nut begins to wear, causing undesirable slippage of the lock nut while mounted in place. As a result, after these lock nuts have been used, undesirable and completely unwanted detachment of the lock nut from the shaft occurs, resulting in loss of the lock nut and possible loss of the entire pierced earring.

In order to eliminate this problem, various attempts have been made to provide a completely new locking system for securely mounting pierced earrings in user's ears. The only two such systems of which I am aware are found in Driscoll U.S. Pat. Nos. 3,446,033 and 3,446,034.

In Driscoll U.S. Pat. No. 3,446,033, a one-piece earring holding shaft is disclosed, but without the use of any pivoting or moving portions formed thereon. Instead, Driscoll U.S. Pat. No. 3,446,033 teaches a one-piece earring shaft construction extending from the ornament, and incorporating a combination of angular bends.

Although Driscoll U.S. Pat. No. 3,446,033 does teach a system which eliminates the difficulties presently encountered with lock nuts, the Driscoll U.S. Pat. No. 3,446,033 system requires the user to manipulate the earring in a variety of alternative positions, to insert the elongated peculiarly convoluted shaft into position, with the convoluted portions thereof performing the holding function. Due to the high degree of dexterity and unnatural manipulated movements required in order to completely insert the construction taught by Driscoll U.S. Pat. No. 3,446,033, this construction has not received popular acceptance.

In Driscoll U.S. Pat. No. 3,446,034, another holding system is taught for a pierced earring wherein two or more pendants are required and are supported by nylon filaments connected to a cylindrically-shaped toggle. The independent toggle is inserted through the pierced ear and, when one of the pendants is pulled, assumes a locking position. When removal is required, the pendant connected to the terminating end of the toggle is pulled, aligning the toggle for removal through the pierced ear.

As would be clearly obvious to one skilled in the art, this system is extremely limited in that it requires the use of flexible filaments which are positioned in the ear when the earring is worn. This is generally undesirable and unwanted by users. Furthermore, the dual-pendant construction which is required to properly operate the toggle is extremely limiting and prevents a pierced earring construction which will accommodate the majority of present day pierced earring designs.

As is clearly apparent from this review of prior art pierced earring holding systems, there is a long-felt need, which is yet satisfied, for a pierced earring holding system which is (1) easily employed by the user without requiring uncomfortable and unnatural manipulative movements of the earring during the insertion process, and (2) securely locked in position without fear of loss of any locking portion or of the earring itself.

Therefore, it is a principal object of this invention to provide a pierced earring holding system which is easily and quickly inserted into the pierced ear and rapidly locked into position.

Another object of the present invention is to provide a pierced earring holding system having the characteristic features defined above having a one-piece construction with the locking portion integrally formed with the pierced earring shaft.

Another object of the present invention is to provide a pierced earring holding system having the characteristic features defined above which can be employed on all pierced earring designs regardless of the size or shape or construction of the visible ornamentation.

Other and more specific objects will in part be obvious and will in part appear hereinafter.

SUMMARY OF THE INVENTION

All of the difficulties encountered in the prior art pierced earring holding systems are completely eliminated and obviated with the holding system of the present invention. In the holding system of this invention, a substantially straight, elongated shaft is mounted to the particular ornament, or to the holding receptacle for the ornament, with the shaft incorporating a terminating portion which is pivotally engaged with the remainder of the shaft. This pivotal portion, which forms the terminating end of the shaft, is readily moveable between a first position in which the axis of the pivotal portion substantially coincides with the axis of the elongated shaft, to a second position wherein the axis of the pivotal portion is substantially perpendicular to the axis of the elongated shaft.

In this way, the pierced earring holding system of the present invention is easily inserted in the pierced ear of the user, in the conventional fashion, with the pivotal portion in its first position. When the pivotal portion is in its first position, the entire shaft comprises a substantially straight elongated member, which is quickly and easily inserted into the pierced ear of the user without any difficulty being encountered by the user.

Once the major portion of the shaft has been located in the pierced ear of the user, the pivotal, terminating end portion of the shaft is quickly and easily pivoted into the second position, forming a locking arm which prevents egress of the supporting shaft from the pierced ear. In this way, the one piece, unitary self-locking shaft of the present invention assures complete locking engagement in the pierced ear of the user, without requiring any unconventional or difficult manipulative effort by the user, while also eliminating the need for employing any independent piece which can be dislodged or lost during use.

The invention accordingly comprises an article of manufacture possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

Figure 4:
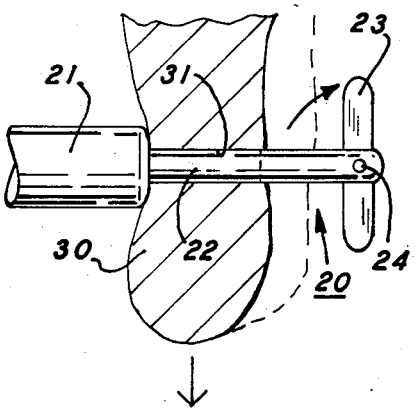
Figure 5:
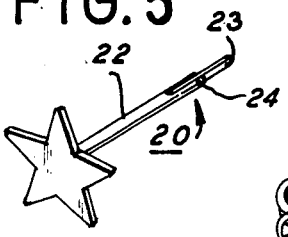
Figure 6:
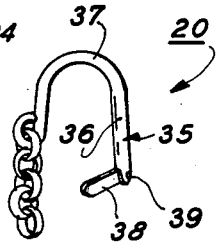
Figure 7:
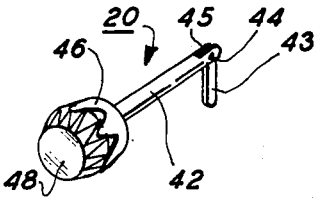
Figure 8:
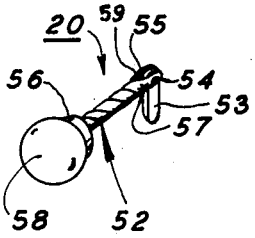

FIG. 4 is a side elevation view showing the pierced earring holding system of the present invention securely positioned in a pierced ear and locked in place; and FIGS. 6 through 16 show various alternative embodiments of the pierced earring holding system of the present invention, with FIGS. 6–8 also showing alternative ornamental construction and stone arrangements which are capable of being employed with the pierced earring holding system of this invention.

DETAILED DESCRIPTION

Figure 1:
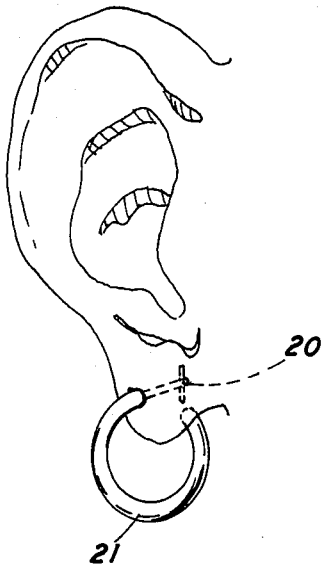
FIG. 1 is a perspective view of a typical pierced earring incorporating the pierced earring holding system of the present invention shown mounted in a pierced ear.
Figure 2:
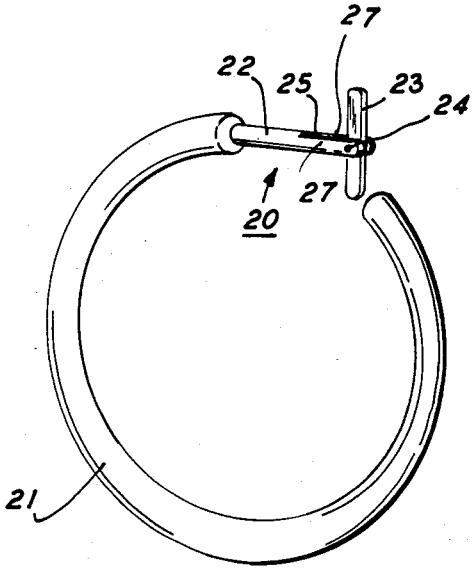
FIG. 2 is a perspective view of the pierced earring of FIG. 1 incorporating the pierced earring holding system of the present invention.

In FIGS. 1 and 2, one embodiment of the pierced earring holding system of 20 of the present invention is shown mounted to a conventional earring ornamental design structure 21, for exemplary purposes only, design structure 21 is shown as a ring. In FIG. 1, earring holding system 20 and its associated ring 21 is shown mounted in its securely engaged position in the pierced ear of a user.

Pierced earring holding system 20 of the present invention incorporates a thin, elongated shaft 22 and a locking bar 23 pivotally engaged with shaft 22 all of which are assembled to form a unitary one-piece integral holding system. Locking bar 23 is mounted to the distal end of shaft 22 by suitable securement means, such as a pivot pin 24. Furthermore, bar 23 preferably comprises smoothly rounded edges and corners and a thickness which is sufficiently less than the diameter of shaft 22 to allow pivoting ease of bar 23. With this construction, locking bar 23 is capable of arcuate movement about the axis defined by pivot pin 24, as well as being smooth constructed for ease of insertion and removal from a pierced ear.

As shown in FIG. 2, this embodiment of pierced earring holding system 20 incorporates a shaft 22 having a suitable recess 25 form therein for accommodating a portion of bar 23. Recess 25 accommodates a portion of bar 23 when bar 23 is pivoted into position with its longitudinal axis substantially coincident with the central axis of shaft 22. When locking bar 23 is pivoted into this position, as shown in FIG. 3, holding system 20 of the present invention forms a substantially continuous elongated shaft.

Recess 25 can take many different constructions, depending upon the particular construction for bar 23. In the construction of this embodiment, bar 23 is mounted to shaft 22 substantially midway along the length of bar 23, and is pivotable into recess 25 in either direction. As a result, shaft 22 preferably incorporates elongated arms 27 extending from the major portion of shaft 22, with these arms being in juxtaposed spaced facing relationship to each other. The space formed between facing arms 27 comprises recess 25. In this way, bar 23 is fully rotationally about axis 24, capable of both entering recess 25 from either direction, as well as completely passing through recess 25.

Pierced earring holding system 20 of the present invention is securely mounted to ring 21, or any other design structure, in the conventional manner. In this particular embodiment, shaft 22 extends into an accommodating hole formed in ring 21, and is affixed thereto in a conventional fashion, such as brazing. As a result, pierced earring holding system 20 can be employed with any pierced earring design, regardless of its physical structure, by merely affixing holding system 20 to the particular design structure using present state of the art techniques employed for the conventional elongated straight shafts requiring locking nuts.

Figure 3:
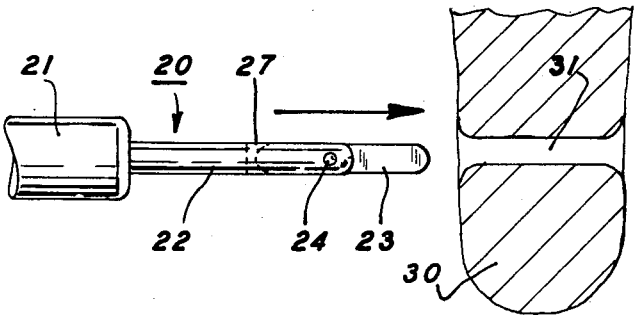
FIG. 3 is a side elevation view showing the pierced earring holding system of the present invention prior to insertion in a pierced ear.

By referring to FIGS. 3 and 4, the quick, easy and efficient insertion and locked engagement of the pierced earring holding system 20 of the present invention in a pierced ear can best be understood. In FIG. 3, pierced earring holding system 20 is shown being advanced towards a pierced ear 30 in which a channel 31 has been formed. With locking bar 31 pivoted into its aligned position, pierced earring holding system 21 assumes the shape of a continuous straight elongated shaft, which is quickly and easily inserted into channel 31 of ear 30, with ease and simplicity with which pierced earring wearers have become adept.

Once the pierced earring has been fully inserted into the user's ear, shaft 22 of holding system 20 is located within channel 31 of ear 30, as shown in FIG. 4. When in this position, the user can easily pivot locking bar 23 from its axially aligned position into its locking position, wherein the longitudinal axis of locking bar 23 is substantially perpendicular to the axis of shaft 22. Once locking bar 23 has been pivoted through this 90° arc of rotation, the earring is securely engaged and locked in the pierced ear of the user, completely eliminating fear of dislocation, dislodgement, or loss of any separate, removable locking portion. This securely engaged lock position is also represented in FIG. 1.

By referring to FIG. 4, the unique distinctions between this embodiment of locking and holding system 20 and typical prior art cuff links can best be understood. As is well known to one of ordinary skill in this art, cuff links have long had a locking and holding structure similar to this embodiment of the present invention. However, in addition to size, cuff links require some type of a biasing system built into the cuff link structure in order to hold the cuff link in either one of its two alternate positions. Typically a spring arrangement is used for the required biasing system.

The cuff link structure requires a biasing system since a positive force is necessary to resist the various rotation-inducing forces acting upon the locking member during use of the cuff link. If any of these forces were successful, the cuff link could become dislodged from the shirt and possibly lost.

In the present invention, biasing systems are not required due to the synergistic interaction of this embodiment of the locking and holding system of the present invention with the user's ear. As shown in FIG. 4, the user elongates ear 30, when the earring is being inserted, by pulling downward on the ear lobe. This downward force causes channel 31 to widen while also producing an overall thinning of ear 30.

While ear 30 is in this elongated and thinned configuration, locking bar 23 is pivoted from in first, ear inserting position to its second, locked position. Once locking bar has been pivoted to its locked position, the downward force on ear 30 is removed, allowing ear 30 to return to its original length and thickness.

As shown in FIG. 4, when ear 30 regains its original thickness, ear 30 cooperatingly interacts with locking bar 23 to prevent unwanted rotation of locking bar 23 into its first position. Since locking bar 23 is incapable of pivoting against the resistive force provided by ear 30, unwanted loss or accidental dislodgement of the earring from the ear is eliminated without the use of biasing systems. It is believed that this unique cooperative interaction between locking and holding system 20 of this invention and the user's ear produces a synergistic effect which is not apparent from the prior art alone.

Although exact sizes and shapes for the pierced ear holding system 20 of the present invention varies depending upon the particular pierced earring structure to which shaft 22 is attached, it has generally been found that elongated shaft 22 comprises an overall diameter of about one millimeter. Furthermore, the overall length of shaft 22, which includes juxtaposed facing arms 27, would preferably be about 7/16 inches long.

Since locking bar 23 is pivotally engaged at the distal end of shaft 22 and has a position wherein a portion of locking bar 23 is coaxially aligned withshaft 22, bar 23 must have an overall thickness less than the one millimeter diameter of shaft 22. Preferably, locking bar 23 comprises a thickness of 0.5 to 0.75 millimeters. Although locking bar 23 may comprise a variety of lengths, it has been found that an overall length of about 5/16 inches assures secure locked engagement of pierced earring locking system 20, while also being easily handled and manipulated by the user.

In FIGS. 5 through 8, various alternative pierced earring design structures are shown, for exemplary purposes only, to depict the versatility of alternative earring designs and constructions with which locking and holding system 20 of the present invention can be employed. These four alternatives represent only a small percentage of the many differet designs that are available to pierced earring wearers, but represents the fact that elongated shaft 22 of the locking and holding system 20 of the present invention is employable with every pierced earring design structure presently being marketed.

As should be obvious to one skilled in the art, elongated shaft 22 of locking and holding system 20 of the present invention comprises a proximal end similar in structure to the proximal end of the posts presently employed with locking nuts. Consequently, locking and holding system 20 of this invention can be used in each and every design on which straight elongated posts with locking nuts are now being used in pierced earring constructions.

In FIGS. 6, 7 and 8, alternative embodiments of the locking and holding system 20 of the present invention are shown. In the embodiment shown in FIG. 6, locking and holding system 20 comprises a shaft 35 which incorporates a substantially straight portion 36 and a arcuate portion 37, with arcuate portion 37 terminating in an eyelet from which the particular ornament is either directly engaged or suspended by suitable decorative link members.

Furthermore, this embodiment incorporates a locking bar 38 which is pivotally engaged in the terminating end of straight section 36 of shaft 35, using a pivot pin 39, with locking bar 38 being pivotally engaged near one of its ends. With this construction, locking bar 38 pivots between substantially the same two positions, namely a first position wherein the longitudinal axis of bar 38 is substantially aligned with the central axis of straight portion 36 of shaft 38, and a second position wherein the longitudinal axis of locking bar 38 is substantially perpendicular to the axis of straight portion 36 of shaft 35 (shown in FIG. 6). The major difference between this construction and the locking bar of the previous embodiment is that locking bar 38 is not capable of pivoting 360° about the pivot axis formed by pivot pin 39.

If a wearer were to employ the embodiment shown in FIG. 6, locking bar 38 would be pivoted into its first position with its longitudinal axis substantially aligned with the central axis of straight portion 36 of shaft 35, and inserted in the conventional fashion through the pierced ear of the user. With this particular design, the earring is mounted in its proper position when arcuate portion 37 of shaft 38 is located within the channel of the pierced ear. Then, to assure secure lock engagement of the pierced earring, the user simply pivots locking bar 38 into its second position, with the longitudinal axis of locking number 38 extending substantially perpendicular to the longitudinal axis of straight portion 36 of shaft 35. In this position, the user is assured of secure, locked engagement of the pierced earring in the pierced ear without fear of dislodgement, dislocation, or loss of any separate removable portion.

In FIG. 7, a further embodiment of pierced earring locking and holding system 20 of the present invention is shown. In this embodiment, shaft 42 comprises a substantially straight, thin, elongated shaft member with a locking bar 43 pivotally engaged at the distal end of shaft 42. In this embodiment, locking bar 43 is pivotally mounted near one of its ends to shaft 42 by means of a pivot pin 44. This construction is similar to the construction discussed above in reference to FIG. 6, with this embodiment comprising only an elongated straight shaft 42, similar to the locking and holding system 20 of FIGS. 2 and 5.

The proximal end of shaft 42 is secured to the base of a gemstone holder 46. Gemstone holder 46 is shown with a gemstone 48 securely mounted therein, forming the particular ornament which will be viewable when the pierced earring is mounted in position.

In this embodiment, shaft 42 comprises a recess 45 formed in the distal end of shaft 42, extending substantially along the central axis of shaft 42, and accommodates the pivoting movement of locking bar 43. However, recess 45 need only extend a short distance from distal end of shaft 42, since only a small portion of locking bar 43 need move therethrough during the pivoting movements of locking bar 43.

If desired, recess 45 could extend from the distal end of shaft 42 inwardly, along the shaft's central axis, a distance equal to the entire length of locking bar 43 from pivot pin 44 to the far end of locking bar 43. This construction allows locking bar 43 to rotate 360° about its pivot axis. However, as the length of recess 45 is increased, the solid portion of shaft 42 decreases. This imparts a potential weakness in the overall strength of shaft 42, and is preferably avoided.

Although locking bar 43 is capable of pivoting about pivot pin 44 through an arcuate distance equal to about 270°, locking bar 43 preferably is moved between only two major positions, which are about 90° apart. In the first position, which is used when the pierced earring is to be inserted into the pierced ear, locking bar 43 is moved to a position with its longitudinal axis substantially aligned with the central axis of shaft 42. As discussed above in reference to the other embodiments, in this position locking and holding system 20 comprises a substantially straight, elongated shaft which is quickly and easily inserted into the pierced ear of the user.

Once the earring has been inserted into the pierced ear, locking bar 43 is moved arcuately a distance of about 90° into its second position with the longitudinal axis of locking bar 43 extending substantially perpendicular to the central axis of shaft 42. In this position, locking bar 43 provides a secure, locked, engagement of the pierced earring with the pierced ear of the user, eliminating any potential problem of loss or dislodgement.

In this embodiment as well as the embodiment discussed in reference to FIG. 6, various systems for biasingly securing locking bar 43 in either of its alternative positions can be incorporated into the locking and holding system 20 to further enhance the usefulness and applicability of the secure, one-piece locking system of this invention. One such biasing and locking construction is described below in reference to a further embodiment of the present invention.

In FIG. 8, another embodiment of the one-piece, integral locking and holding system 20 of the present invention is shown formed from a unitary assembly of parts. In this embodiment, locking and holding system 20 comprises a substantially straight elongated shaft 52, with a locking bar 53 pivotally mounted at the distal end of shaft 52, using a pivot pin 54. This embodiment differs substantially from the previous embodiments discussed above in that shaft 52 comprises two individual portions 57 and 59 which have been intertwined to form a continuous, twisted, rope-like configuration, while also achieving a substantially straight shaft 52. In this embodiment, the terminating end of twisted portion 57 and the terminating end of twisted portion 59 are interengaged by pivot pin 54, with locking bar 53 mounted therebetween. As shown in FIG. 8, locking bar 53 is preferably pivotally mounted near one of its ends, providing a locking structure similar to the embodiment discussed in reference to FIG. 7.

If desired, locking bar 53 can be mounted between the terminating ends of portions 57 and 59 with locking bar 53 pivotally engaged substantially at its midpoint. However, if locking bar 53 is pivotally engaged along its midpoint, portions 57 and 59 must be removed from intertwined secure interengagement at a position earlier than is shown in FIG. 8, in order to provide a recess area 55 therebetween which will accommodate the greater length of locking bar 53. Although such a construction is clearly available if so desired, it has been found that by maximizing the intertwined engagement of portions 57 and 59, a more rigid and sturdy construction is achieved. As a result, the construction shown in FIG. 8 is preferred.

The particular ornament 58 shown in this embodiment comprises a pearl, with portions 57 and 59 forming shaft 52 being directly mounted at their proximal end to a pearl holding and receiving cup 56.

In FIGS. 9, 10, 11 and 12, another embodiment of the locking and holding system of the present invention is shown. In this embodiment, locking and holding system 20 comprises an elongated, substantially straight shaft 62 having a locking bar 63 pivotally engaged at the distal end of shaft 62, using a pivot pin 64. This embodiment differs from previous embodiments by providing a locking bar 63 having two separate, independently pivotable sections 66 and 67.

Preferably, sections 66 and 67 are split along the longitudinal axis of locking bar 63, forming two substantially equally sized and shaped members. In this way, sections 66 are identical and can be manufactured from the same mould.

As shown in FIG. 10, this embodiment allows locking bar 63 to be pivotally engaged near one of its terminating ends, with sections 66 and 67 being arcuately pivoted about the axis defined by pivot pin 64 in opposite directions. In this way, pivotable locking bar 63 achieves a position with its longitudinal axis substantially perpendicular to the central axis of shaft 63, with locking bar 63 having substantially equal length segments extending from both sides of shaft 62.

With this construction, the advantages of both the end pivotable locking bar and the centrally pivotable locking bar are realized, without the disadvantages of either. In particular, this construction achieves both the (1) enhanced structural integrity and reliability of the small, finely constructed members by eliminating unnecessary elongated recesses extending a substantial distance along a particular shaft, and (2) added security and locked engagement by having substantially equal length segments of the locking bar extending from opposite sides of the elongated shaft when mounted in a pierced ear.

In the preferred embodiment of the split locking bar construction, locking bar sections 66 and 67 also preferably incorporate at least one small boss or post 68 formed on the outer surface of each locking section 66 and 67. Also, elongated shaft 62 comprises recess areas for cutouts 69 formed in the outer peripheral surface of shaft 62 at the distal end thereof. Preferably, three recesses are employed with each of the recesses being spaced about 90° from each other, as shown in FIGS. 10 and 11.

By employing recesses 69 and post 68, this embodiment of locking and holding system 20 assures the biased, locked engagement of sections 66 and 67 of locking bar 63 in either of the two alternative positions, when so desired. As shown in FIG. 10, when section 67 has been pivoted to its downward position with its longitudinal axis substantially perpendicular to the central axis of shaft 62, post 68 engages recess 69, assuring the locked interengagement of and secure holding of section 67 in this position. Similarly, section 66 is locked in its oppositely extending position. In this way, the user is assured that locking bar 63 is securely maintained in the locked position, assuring that the pierced earring will not become dislodged from the ear of the wearer.

As shown in FIG. 9, sections 66 and 67 of locking bar 63 can be easily locked in the first position, with the longitudinal axis of locking bar 63 substantially coinciding with the central axis of shaft 62. When this position is desired, locking posts 68 of section 66 and 67 are positioned and securely retainingly engaged in recesses found in the tip of shaft 62. With locking bar 63 securely maintained in this position, the earring is ready for quick and easy insertion into the ear of the wearer.

Although the split locking bar construction discussed above can be manufactured in a variety of ways, one of which would be to eliminate posts 68 and recesses 69, it has been found that the construction defined above for locking bar 63 along with posts 68 and recesses 69 is the preferred construction. However, as would be obvious to one skilled in the art, a variety of alternative locking systems can be employed without department from the scope of the present invention.

In FIG. 13, an alternative embodiment of pierced earring holding system 20 of the present invention is shown. In this embodiment, the integrally twisted rope configuration for shaft 52 defined in reference to FIG. 8 is employed in combination with locking bar sections 66 and 67. As discussed above, elongated straight shaft 52 comprises two independent elongated portions 57 and 59, which are integrally intertwined to form a substantially straight, elongated shaft 52. Locking bar sections 66 and 67 are mounted at the terminating ends of portions 57 and 59 using pivot pin 54. If desired, biasing locking and holding posts 68 and recesses 69 can be incorporated into this construction in order to provide the secure biased and locked positions for locking bar sections 66 and 67.

Furthermore, if desired, shaft 52 can be constructed to allow locking bar sections 66 and 67 to rotate 360° about the axis defined by pivot pin 54. This can be easily achieved by providing a recess 55 which extends from the distal end of shaft 52 forwardly a sufficient distance to accommodate the entire length of sections 66 and 67. Although this construction can be made, if so desired, the construction shown in FIG. 13 is preferred, since it optimizes the integral contact between portions 57 and 59, reducing the length over which these two portions are not in integral, intertwined contact.

In FIGS. 15 and 16, an alternative embodiment of the pierced earring holding system 20 of the present invention is shown incorporating the integrally twisted, rope-like configuration. In this embodiment, locking and holding system 20 incorporates locking bar 23 which is pivotally mounted on a single elongated wire member 81 substantially at the midpoint of elongated wire 81.

The substantially straight elongated shaft 82, shown in FIG. 16, is formed from the single elongated wire 81 by first installing locking bar 23 on wire 81 by inserting wire 81 through hole 84 which defines the pivot axis of locking bar 23. Then, wire 81 is bent about a portion of locking bar 23 to form two substantially equal length, parallel wire segments 83 with the two terminating ends 85 of segments 83 of wire 81 in juxtaposed spaced relationship to each other. In FIG. 15, wire 81 is shown with substantially equal length segments 83 having been formed but not completely bent into their substantially parallel configuration.

Segments 83 are then intertwiningly twisted to form the intertwined, twisted rope-like elongated shaft 82 shown in FIG. 16. It has been found that this construction provides a quick and easy assembly procedure while also providing an extremely sturdy, well constructed embodiment for locking and holding system 20.

One important advantage of this embodiment is that locking bar 23 pivots about a portion of wire 81, thereby eliminating the necessity for use of a separate pivot pin. Furthermore, locking bar 23, as shown in FIG. 16, is mounted in a manner which allows complete rotation of locking bar 23 about its pivot axis without affecting the inherent strength or rigidity of shaft 82.

If desired, locking bar 23 could be mounted near one of its ends with shaft 82 being formed with the locking bar capable of either limited pivoting or complete rotation about its axis.

The use of a single, continuous wire member 81 to form intertwined, twisted shaft 82, as well as the supporting and holding member for pivotable locking bar 23, provides an extremely unique construction. This embodiment achieves a unitary, solid construction, wherein the locking and holding is quickly and inexpensively manufactured with a minimum of parts and with maximum ease and efficiency, while also providing a locking and holding system having no member which can become dislodged, loosened, or in any way separated and lost. Furthermore, as discussed above in reference to FIG. 4, this embodiment cooperated with the ear to prevent unwanted rotation of locking bar 23 when mounted in the user's ear. This cooperation is important, since a biasing system could not be efficiently introduced into this embodiment.

In FIG. 14, an alternative shaft construction for the locking and holding system 20 of the present invention is shown. In this construction, shaft 72 has locking bar 73 pivotally mounted at its distal end by pivot pin 74, with locking bar 73 pivotally engaged near one of its terminating ends. In this embodiment, shaft 72 comprises a recess 75 extending forwardly from the distal end of shaft 72, a distance sufficiently great enough to accommodate at least the length of locking bar 73 from the pivot axis to its opposite terminating end. As a result, locking bar 73 is free to rotate 360° about the axis defined by pivot pin 74. As discussed above in reference to FIGS. 2 and 5, this construction essentially provides 72 with a split, fork-like distal end having two tines or arms 78 in juxtaposed spaced facing relationship, creating recess 75 therebetween.

As shown by the phantom line along the longitudinal axis of locking bar 73, this embodiment can employ a locking bar 73 having two independent sections, represented by phantom sections 76 and 77.

Although this elongated recess embodiment provides locking and holding system 20 with a shorter overall length, it is believed that the increased length of recess 75 imparts a slight reduction in the rigidity of shaft 72. Consequently, although this embodiment can be employed if so desired, the alternative embodiments discussed above are preferably employed.

It will thus be seen that the object set forth above, among those made apparent from the preceding description, are efficiently attained, and since certain changes may be made in the above article without department from the scope of invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by letters patent is:

1. A one-piece, integral, locking and holding system for pierced earrings comprising:

(A) a shaft having
  (a) a distal end, and
  (b) a proximal end mounted to the decorative viewable portion of the earring;

(B) a locking bar pivotally engaged by pivot means with the distal end of the shaft near one end of the bar and
  (a) movable from a first position with the longitudinal axis of the locking bar substantially parallel to the central axis of the shaft, to
  (b) a second position with the longitudinal axis of the locking bar substantially perpendicular to the central axis of the shaft, and
  (c) comprising two independent sections, each of which are individually pivotable about the axis defined by pivot means through an arc of at least 180°, allowing each of the sections to be moved in opposite directions, to provide a substantially continuous locking bar having a longitudinal axis perpendicular to the central axis of the shaft with said bar extending in opposite directions from the shaft; and (C) pivot means integrally connecting the shaft and the locking bar, and providing the axis about which the locking bar pivots, whereby, a one-piece, integral, locking and holding system is achieved which is easily insertable in a pierced ear as a substantially straight member, and is quickly moved into a secure, locked position, eliminating unwanted dislodgement from the ear by easily moving the locking bar sections in opposite directions.

2. A one-piece, integral, locking and holding system for pierced-ear earrings comprising (A) a shaft having
  (a) a distal end comprising at least two cutout portions peripherally surrounding a portion of the distal end of the shaft, with said cutout portions being positioned substantially 90° from each other, and
  (b) a proximal end for mounting to the decorative viewable portion of the earring;

(B) a locking bar comprising
  (a) two independent sections pivotally engaged with the distal end of the shaft and movable between
    (1) a first position with the longitudinal axis of the section substantially parallel to the longitudinal axis of the shaft, and
    (2) a second position with the longitudinal axis of the section substantially perpendicular to the longitudinal axis of the shaft, with the second position being attainable by moving the sections in opposite directions, and
  (b) recess engaging posts formed on the outer peripheral surface thereof for cooperative engagement with the cutout portions formed on the shaft, thereby providing a substantially continuous locking bar having a plurality of alternative locked positions wherein the locking bar is securable in the alternative positions by the engagement of the posts with the cutouts; and (C) pivot means integrally connecting the shaft and the locking bar, and providing the axis about which the locking bar pivots, whereby, a one-piece, integral, locking and holding system is achieved which is easily insertable in a pierced ear as a substantially straight member, and is quickly moved into a secure, locked position, eliminating unwanted dislodgement from the ear.

3. A one-piece, integral, locking and holding system for pierced-ear earrings comprising:

(A) a shaft having a distal end and a proximal end mounted to the decorative viewable portion of the earring, said shaft incorporating two independent portions in twisted, intertwined engagement for substantially their entire lengths with the two portions being separated at their distal ends to form a receiving zone therebetween for interengagement with a locking bar;

(B) a locking bar pivotally engaged with the distal end of the shaft and movable between
  (a) a first position with the longitudinal axis of the locking bar substantially parallel to the central axis of the shaft, and
  (b) a second position with the longitudinal axis of the locking bar substantially perpendicular to the central axis of the shaft;

(C) pivot means integrally connecting the shaft and the locking bar, and providing the axis about which the locking bar pivots, whereby, a one-piece, integral, locking and holding system is achieved which is easily insertable in a pierced ear as a substantially straight member, and is quickly moved into a secure, locked position, eliminating unwanted dislodgement from the ear.

4. The one-piece, integral, locking and holding system defined in claim 3, wherein the two independent portions are joined to each other at juxtaposed ones of their respective ends.

5. The one-piece, integral, locking and holding system defined in claim 4 wherein the distal ends of the two independent portions are joined, with the pivot means comprising the joining portion.

6. The one-piece, integral, locking and holding system defined in claim 3, wherein the locking bar is defined as being pivotally engaged by pivot means with the distal end of the shaft near one end of the bar, and the locking bar comprises (c) two independent sections, both of which are pivotable about the axis defined by the pivot means, allowing each of the sections to be moved in opposite directions, thereby providing a substantially continuous locking bar having a longitudinal axis perpendicular to the central axis of the shaft with said bar extending in opposite directions from the shaft.

7. The one-piece, integral locking and holding system defined in claim 6, wherein the two sections forming the locking bar are defined as being substantially identical to each other.

* * * * *